US008556741B2

(12) United States Patent
Ryan

(10) Patent No.: US 8,556,741 B2
(45) Date of Patent: Oct. 15, 2013

(54) GOLF AID

(76) Inventor: Clete William Ryan, Aitkenvale (AU)

( * ) Notice: Subject to any disclaimer, the term of this patent is extended or adjusted under 35 U.S.C. 154(b) by 0 days.

(21) Appl. No.: 13/257,504

(22) PCT Filed: Mar. 19, 2010

(86) PCT No.: PCT/AU2010/000318

§ 371 (c)(1),
(2), (4) Date: Oct. 31, 2011

(87) PCT Pub. No.: WO2010/105304

PCT Pub. Date: Sep. 23, 2010

(65) Prior Publication Data

US 2012/0040770 A1 Feb. 16, 2012

(30) Foreign Application Priority Data

Mar. 19, 2009 (AU) ..... 2009905483

(51) Int. Cl.
*A63B 69/36* (2006.01)

(52) U.S. Cl.
USPC ..... 473/212; 473/219; 473/238; 473/276

(58) Field of Classification Search
USPC ..... 473/206, 207, 212, 213, 214, 218, 219, 473/226, 227, 276, 278
See application file for complete search history.

(56) References Cited

U.S. PATENT DOCUMENTS

| | | | | |
|---|---|---|---|---|
| 5,145,179 | A | 9/1992 | Breed | |
| 5,501,464 | A | 3/1996 | Dalbo | |
| 5,902,189 | A | 5/1999 | Schultz | |
| 5,904,624 | A | 5/1999 | Martinez | |
| 5,976,024 | A | 11/1999 | Marshall, Jr. | |
| 6,821,210 | B2 * | 11/2004 | Kallage, Jr. | 473/218 |
| 7,033,282 | B1 * | 4/2006 | Flood | 473/227 |
| 7,699,714 | B1 * | 4/2010 | Reynolds | 473/212 |
| 2002/0016211 | A1 | 2/2002 | Moran | |
| 2005/0090323 | A1 * | 4/2005 | Kellogg | 473/218 |

FOREIGN PATENT DOCUMENTS

JP 2009-011539 1/2009

OTHER PUBLICATIONS

International Search Report issued May 10, 2010 in PCT/AU2010/000318.

* cited by examiner

*Primary Examiner* — Nini Legesse
(74) *Attorney, Agent, or Firm* — Stein IP, LLC

(57) ABSTRACT

A golf aid including a yoke portion with a pair of the divergent upper portions, a pair of forearm guide portions, one associated with each of the divergent upper portions of the yoke and a resilient means to bias the forearm guide portions into an extended condition whereby a user's forearms apply force to the forearm guide portions against the biasing force in order to maintain optimum spacing between the user's forearms.

24 Claims, 18 Drawing Sheets

GOLF AID

CROSS-REFERENCE TO RELATED APPLICATIONS

This application is a National Phase of PCT International Patent Application No PCT/AU2010/000318, filed Mar. 19, 2010, and Australian Patent Application No 2009905483, filed Mar. 19, 2009, in the Australian Patent Office, the disclosures of which are incorporated herein by reference.

BACKGROUND OF THE INVENTION

1. Field of the Invention

The present invention relates generally to the field of golf swing aids and particularly to a swing aid to assist with training a user to obtain and maintain the optimum angel between their forearms.

2. Description of the Related Art

There are many golf aids on the market directed to providing a user with a "better" swing.

These include a variety of golf aids which are directed to maintaining or promoting the correct wrist angle during the swing and also numerous aids are directed to creating a smoother and more even tempo in the swing. Many of the golf aids directed to maintaining or promoting the correct wrist angle during the swing have devices or components which abut the wrist during the swing. For this reason alone, they generally impinge on free movement of the wrist thereby creating a more artificial and therefore less repeatable swing.

Some of these aids are adapted to be used indoors but typically without the use of a club.

The inventor of the present invention has surprisingly found that if a golfer controls the angle between their forearms during the swing, the swing mechanics, including plane and tempo are greatly improved.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a clamp, which may at least partially overcome at least one of the abovementioned disadvantages or provide the consumer with a useful or commercial choice.

With the foregoing in view, the present invention in one form, resides broadly in a golf aid including a resilient V-shaped tension yoke with divergent upper portions, a pair of forearm guide portions, one associated with each of the divergent upper portions, the forearm guide portions biased into an extended condition by the resilient V-shaped tension yoke whereby a user's forearms apply force to the forearm guide portions against the biasing force in order to maintain optimum spacing between the user's forearms.

In another embodiment the golf aid includes a flexible Y-shaped yoke portion with a depending portion and a pair of the divergent upper portions, a pair of forearm guide portions, one associated with each of the divergent upper portions of the yoke and a resilient spacing assembly positioned between the forearm guide portions and biased into an extended condition whereby a user's forearms apply force to the forearm guide portions against the biasing force in order to maintain optimum spacing between the user's forearms.

The golf aid of the present invention will typically assist with maintaining a user's forearms in the correct position both at address and throughout the backswing and downswing.

Typically, the golf aid of the present invention will be used during practice sessions rather than during game play.

The golf aid of the present invention may be utilized with a user's own club or with a practice club specifically designed for use in association with the golf aid. In either case, the club will typically include an elongate shaft and a head portion.

Where provided, the practice club will typically include a shaft made from a solid yet flexible material. The practice club shaft may be manufactured from any existing shaft material such as steel, graphite or composite or a new material. The practice club shaft may be weighted. Preferably, the practice club shaft will be shorter than normal in order to allow the practice club and golf aid to be used indoors. According to a particularly preferred embodiment, the practice club shaft will be between approximately one half and three quarters of the length of normal shaft.

Normally, the shaft will be attached to the yoke of the golf aid via a connector assembly. The connector assembly may be of any type but it is preferred that the connector assembly allows easy gripping of the practice club. In another embodiment, tie connector assembly may have a dual purpose of connecting the shaft to the golf aid and also providing a gripping portion. Alternatively, the connector assembly may be such that the gripping portion of a club can still be used when connected to the golf aid.

The preferred connector assembly includes a magnetic attachment assembly with a magnet provided on either the golf aid or a practice club and engaging a magnetically affected metal on the other.

Preferably the magnetic attachment assembly includes a hinged magnetic clip comprising a hinge and a magnetic housing attached to the yoke. The hinge is preferably held and released by a tension clip actuated by one of the forearm guide portions. The magnetic clip attaches to a magnet which can be fastened to the gripping portion of a club. The benefit of a magnetic clip is that it can allow a quick and easy connection to and disconnection of a club to the device.

In another embodiment, the connector assembly includes a collar assembly or portion that receives a portion of the shaft and also a portion of the depending portion of the yoke of the golf aid.

The connector assembly will preferably allow the yoke to flex even when a club is attached. The connector assembly will allow removable connection of a club. A magnetic clip, ball joint or the like may be used.

In a preferred embodiment, compression of the resilient V-shaped tension yoke moves the tension clip which releases the hinge of the magnetic housing in the connector assembly. The benefit of this is that once the initial position of the club and the forearm guide portions has been established, the hinge can be released 20 and move freely during the swing to allow a more natural swinging motion.

In a preferred embodiment, a head may be provided at or towards the lower end of the shaft of the practice club. This head will preferably be weighted. Providing a weighted head increases the centripetal forces during the swing to simulate the forces of a real club.

The head of the practice club may be or include visual indicator means such as a light source, LED or laser, powered by a small battery, so that the path of the club and therefore the golfer's swing path can be visually traced during the swing.

This provides the user with a visual indication of the swing path and can help to achieve a more accurate swing by the user.

In another embodiment a pivot may be provided at or towards the lower end of the shaft of the practice club. Providing the head of a club as a pivoting portion in order to allow "breaking" of the club, particularly the head portion, if the correct swing tempo is not used, is one mechanism of promoting the correct swing tempo. Providing this configuration may also enhance a user's timing and release of the golf club.

Typically, the head of the practice club will be attached to the remainder of the shaft with a short portion of shaft extending from the head and attached to the remainder of the shaft at the pivot.

The head of the practice club will preferably be manufactured from a solid metallic or plastic material and will normally be weighted.

It is further envisaged that the head of the practice club has a shape or features to increase the air resistance as the club is swung. This may be accomplished using vents or openings for example. Alternatively, shaped portions such as wing-shaped portions may be provided to create a force to draw the club away from the user's body when swung.

The head of the practice club may be large but will preferably be quite small for convenience, particularly for indoor use.

The golf aid of the present invention may include the resilient V-shaped tension yoke and a pair of the divergent upper portions. The yoke will normally be resilient and preferably, is manufactured from aluminum or a similar material having a measure of resilience.

The tension yoke will normally be solid in order to provide the correct amount of resilience.

Normally, the forearm guide portions are located on the divergent upper portions.

Each of the forearm guide portions will typically be rigid and strong. They will normally be manufactured from hardened plastic or metal.

The forearm guide portions will normally be between 10 cm and 30 cm in length.

In another embodiment, the golf aid includes a flexible Y-shaped yoke portion with a depending portion and a pair of the divergent upper portions. The yoke will normally be resilient and preferably, is manufactured from rubber or a similar resilient material.

The yoke will normally be hollow in order to receive other elements of the golf aid or club therein.

The yoke may or may not be textured in order to provide increased grip.

Normally, the forearm guide portions are located in openings in the divergent upper portions. An attachment or securing assembly may be used to increase the security of attachment between the forearm guide portions and the yoke. Similarly, the depending portion of the yoke will typically be adapted to receive a portion of a golf club, normally a shaft portion of either a practice club or a normal golf club.

In use, the yoke will normally be located between the wrists and/or the elbows of the user in the correct address position.

In another embodiment, the golf aid also includes a pair of forearm guide portions, one associated with each of the divergent upper portions of the yoke. Each of the forearm guide portions may be alternatively termed a "support post".

Each of the support posts will typically be rigid and strong. They will normally be manufactured from plastic or metal and may be solid or tubular. In order to be relatively lightweight, a tubular construction is preferred.

The forearm guide portions or support posts will normally be between 10 cm and 30 cm in length. The guide portions are dimensioned to fit within the openings in the respective upper portions of the yoke.

The forearm guide portions or support posts will normally either be padded themselves, or will each be associated with a cushioning member. Preferably, any padding or cushioning will cover the length of the forearm guide portions. Normally, the cushioning member or padding will be shaped in order to comfortably abut a user's forearm. According to a preferred form, the cushioning member or padding will preferably be arcuate in cross-section over its length in order to receive a user's arm. An arcuate concave cross-sectional shape is preferred.

The cushioning member will preferably be mounted to the forearm guide portions rather than integrally formed therein. Preferably, the cushioning member will be longer than the support post in order to cover the end of the support post.

The cushioning member or padding may be length adjustable.

The cushioning member may be interchangeable with different sized cushioning members such that the golf aid may be used by users of different sizes, statures and ages.

The cushioning member or padding may be easily removable to allow replacement and cleaning.

In the golf aid of the present invention the resilient V-shaped tension yoke is biased into an extended condition whereby a user's forearms apply force to the forearm guide portions against the biasing force in order to maintain optimum spacing between the user's forearms.

The degree of resistance to compression may also be adjusted by substituting the yoke with different material and/or different thicknesses.

A maximum angle will be set by the resilient V-shaped tension yoke under no compression.

A minimum angle between the forearm guide portions will be defined by the increase of resistance to compression.

The benefit of having the degree of resistance to compression adjustable is that the angle of the user's forearms can be fine tuned for an optimum swing.

In one embodiment, the degree of resistance to compression may also be adjusted by adjusting the tightness between the hinge and the resilient V-shaped tension yoke.

In another embodiment, the degree of resistance to compression may also be adjusted by utilizing a two part resilient V-shaped tension yoke and adjusting the resistance to movement between the two parts of the resilient V-shaped tension yoke. In a further embodiment, the golf aid may also include a resilient spacing assembly positioned between the forearm guide portions and biased into an extended condition whereby a user's forearms apply force to the forearm guide portions against the biasing force in order to maintain optimum spacing between the user's forearms.

The resilient spacing assembly is therefore directed to providing twin features of setting a minimum angle between the forearm guide portions whilst allowing resilient movement between an extended condition and the minimum angle.

Typically, the minimum angle will be set by the resilient spacing assembly. A maximum angle may also be set. Typically, the forearm guide portions are biased into a maximum separation normally through use of a biasing means and a separation assembly.

In addition to setting the minimum and/or maximum angle, the degree of resistance to compression may also be adjusted.

In the embodiment, the resilient spacing assembly will include four components namely a body, a plunger which is telescopically received at least partially within the body, a biasing means to bias the body and plunger into an extended condition and an adjustment means to adjust the parameters of the resilient spacing assembly. Typically, the adjustment means will adjust the minimum separation angle of the forearm guide portions.

The resilient spacing assembly will normally be located extending between the forearm guide portions. Preferably, the body of the spacing assembly will be attached or secured to one of the forearm guide portions and the plunger will be attached or secured to the other of the forearm guide portions.

Typically, the biasing means will be a spring at least partially received within a hollow portion of the body and adjacent the end of the plunger in order to be braced against the body or portion thereof and act on the plunger to bias the two components apart.

The body and/or the plunger may be threaded to allow adjustment of the effective length of the body and plunger combination. Different configurations of threading are possible, such as both the body and plunger may be threaded and rotation of one relative to the other may change the effective length. Preferably however, the spring will be located in a hollow housing portion located inside the body and rotation of an externally provided knob or similar will preferably move the housing toward/away the plunger, thus changing the effective length of the body and plunger and thereby changing the angle between the forearm guide portions.

In use, a user will typically locate the arm guides against the inside portion of their forearms whilst taking the correct grip on a club, whether practice or real. The user may then address a golf ball. Normally, prior to initiation of the swing known as the takeaway, the user may squeeze their forearms together against the biasing force of the resilient spacing assembly. This movement may be used as a trigger to initiate the swing. The user may then use the golf aid to maintain the correct forearm spacing or angle by maintaining pressure on the forearm guide portions during the backswing and downswing.

The golf aid of the present invention is particularly adapted to allow the correct wrist hinge during the golf swing as no component of the golf aid engages or impinges against either wrist of the user during the swing.

Preferably, a practice mat comprising a section of material such as artificial turf with one or more visual guides is used with the golf aid so that the visual path of the swing can be easily compared with the visual guides.

In the preferred embodiment, the practice mat includes one fixed visual guide and at least one adjustable visual guide. The adjustable visual guide may be kept in place on the practice mat by hook-and-loop fasteners, fastening tape, magnets, weights or any other method. The advantage of having an adjustable visual guide is that the path of the swing can be adjusted by tracing the visual path of the swing within the adjustable area defined by the visual guides.

Normally the visual guides will be substantially parallel to each other and define a track through which a correctly swung club will pass. The visual guides will typically be tape or similar flat member which is removeably attachable to the practice mat.

In other embodiments, the practice mat may be provided with electronic means allowing the input or entry of a swing path using the device into a computer or similar, for comparison or recordal.

Some benefits of the golf aid of the present invention include the following:

1. improvement in overall golf swing mechanics;
2. the ability to practice indoors, including any user's home or office for example;
3. maintaining elbows and arms in the correct position during the swing;
4. use as a warm-up tool;
5. a single golf aid may be used by users of different sizes, statures and ages;
6. assist with the creation of a smooth, well timed golf swing;
7. improved visual tracking of the swing; and
8. a more accurate swing

BRIEF DESCRIPTION OF THE DRAWINGS

Various embodiments of the invention will be described with reference to the following drawings, in which.

DETAILED DESCRIPTION OF THE EMBODIMENTS

Figure 1:
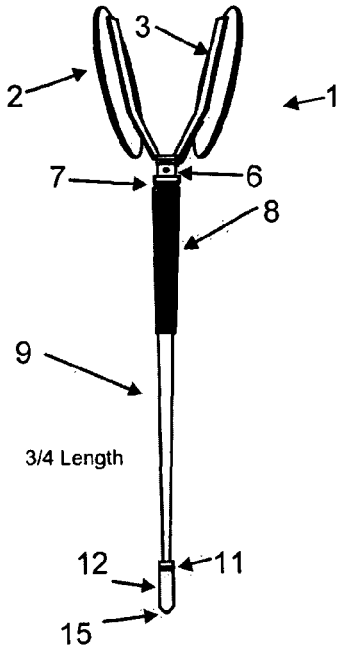
FIG. 1 is a front view of a golf aid with practice club according to a preferred embodiment of the present invention.

In one preferred embodiment as per FIGS. 1 to 13, a golf aid 1 is provided.

As illustrated in the Figures particularly FIGS. 1 to 4, the golf aid 1 includes a resilient V-shaped tension yoke 3 with divergent upper portions, a pair of forearm guide portions 2, one associated with each of the divergent upper portions of the tension yoke 3, the forearm guide portions 2 biased into an extended condition by the resilient V-shaped tension yoke 3 whereby a user's forearms apply force to the forearm guide portions 2 against the biasing force in order to maintain optimum spacing between the user's forearms. The forearm guide portions 2 comprise rigid portions 2*a* and padded portions 2*b*. The padded portions 2*b* comfortably abut a user's forearms. A connector assembly including a hinged magnetic clip comprising a hinge 4 and a magnetic housing 6 which is held and released by a tension clip 5 actuated by 30 one of the forearm guide portions 2. The hinge 4 includes a hinge section 4*b* and a fastening section 4*a* to connect the hinge section 4*b* to the V-shaped tension yoke 3. The magnetic clip 6 attaches to a magnet 7 which can be fastened to the gripping portion 8 of a practice club 9 or a user's own club (not shown).

The golf aid 1 of the present invention may be utilized with a user's own club (not shown) or with a practice club 9 specifically designed for use in association with the golf aid, as illustrated in FIGS. 1, 2 and 6 to 12.

Figure 2:
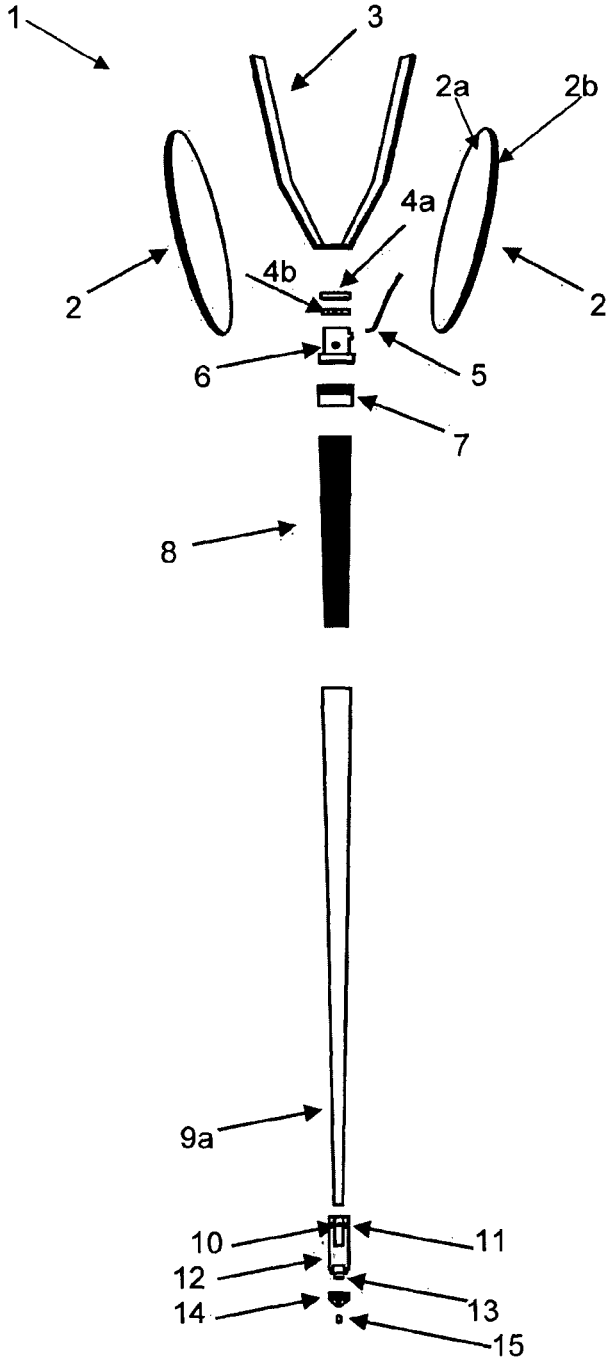
FIG. 2 is an exploded front view of a golf aid and practice club as illustrated in FIG. 1.

The practice club 9 in FIGS. 1 and 2 includes a gripping portion 8 which may be alternatively termed a "handle" or "grip", the practice club 9 also includes a shaft 9*a* manufactured from any existing shaft material such as steel, graphite or composite or a new material, and a weighted head 12. The weighted head 12 contains a visual indicator means 15, a housing 14 for the visual indicator means 15, a battery 13 for the visual indicator means 15, an o-ring groove 11 and a pin locating hole 10 to enable a pin (not shown) to connect the weighted head 12 to the shaft 9*a*.

The practice club shaft 9*a* of the illustrated embodiment is between approximately one half and three quarters of the length of a normal shaft in order to allow the practice club 9 and golf aid 1 to be used indoors.

Once the initial position of the club and the forearm guide portions has been established, the magnetic clip 6 can be released and rotate via the hinge 4 during the swing to allow a more natural swinging motion.

Figure 3:
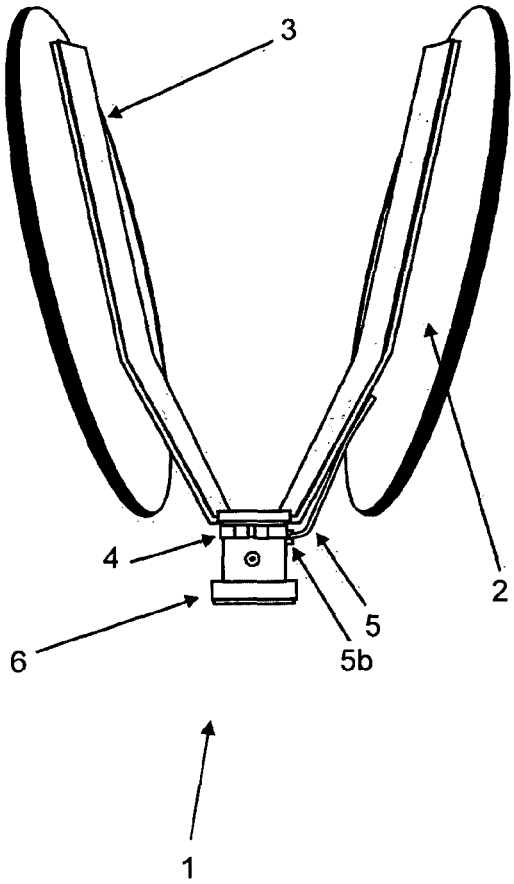
FIG. 3 is a front view of a golf aid at a maximum angle with the magnetic housing held by the tension clip.

The golf aid 1 as illustrated in FIG. 3 is in the uncompressed state, in this state the tension clip 5, which is attached to the resilient V-shaped tension yoke 3, is engaged with the holding means 5*b* on the magnetic clip 6, this prevents rotation of the magnetic clip 6 relative to the resilient V-shaped tension yoke 3 via the hinge 4.

Figure 4:
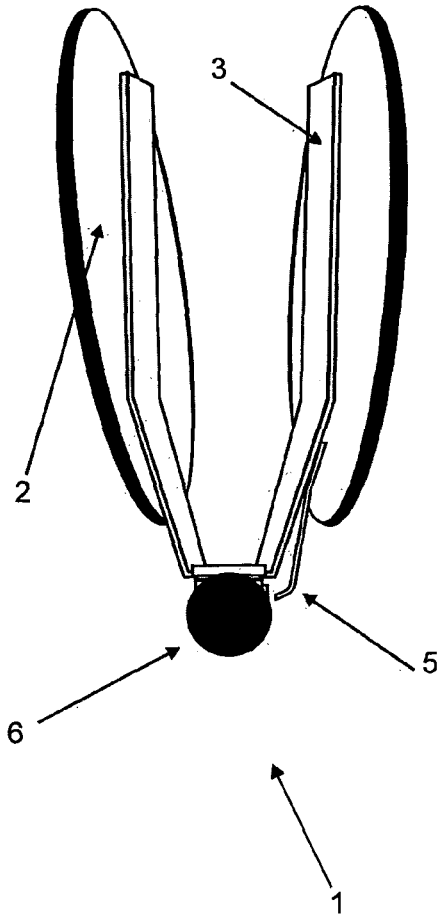
FIG. 4 is a front view of a golf aid at a minimum angle with the magnetic housing released by the tension clip and turned upwards.
Figure 5:
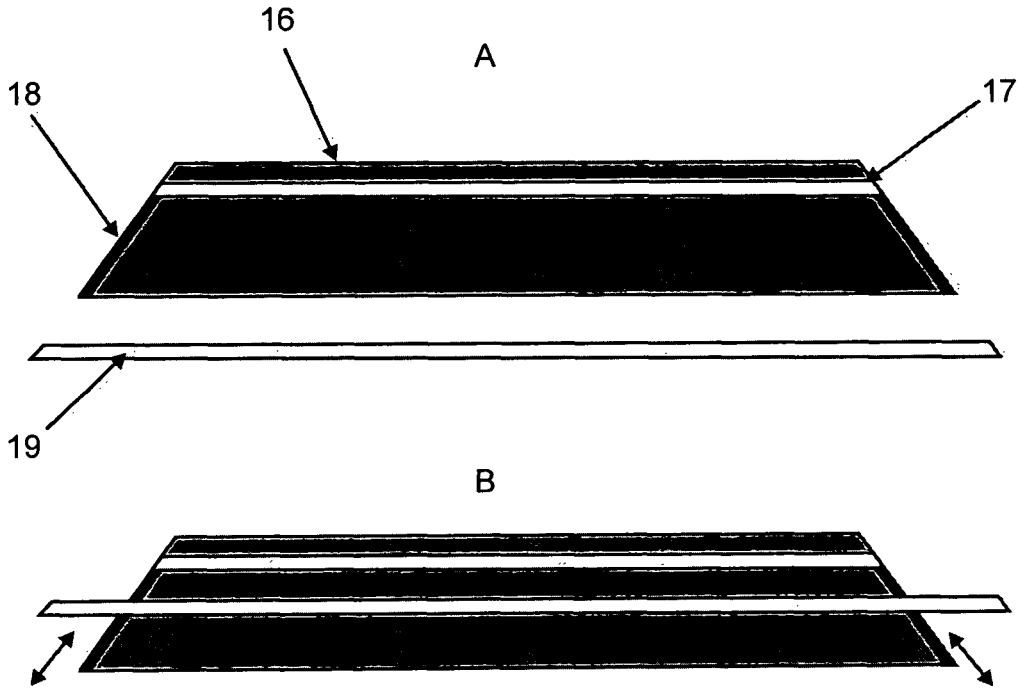
FIG. 5 is a view of the practice turf with the adjustable visual guide.

The golf aid 1 as illustrated in FIG. 4 is in the compressed state, in this state, the compression of the resilient V-shaped tension yoke 3 moves the tension clip 5 such that it is disengaged with the holding means 5*b* (not shown in FIG. 4) this enables rotation of the magnetic clip 6 relative to the resilient V-shaped tension yoke 3 via the hinge 4. The magnetic clip 6 is shown in a released and rotated position in FIG. 4.

The golf aid of the present invention can also be used with a practice mat 16 to assist with the tracking of the visual path of the swing.

As illustrated in FIG. 5A, the practice mat 16 includes a fixed visual guide 17 and an adjustable visual guide 19, the adjustable visual guide 19 can be kept in place by a fastening means 18 as shown in FIG. 5B.

The golf aid of the present invention can also be used to assist with the initiation of the swing or a swing trigger.

Typically, the golf aid 1 of the embodiments illustrated will be used during practice sessions rather than during game play and use of the golf aid in this manner is illustrated in FIGS. 6 to 12.

Figure 6:
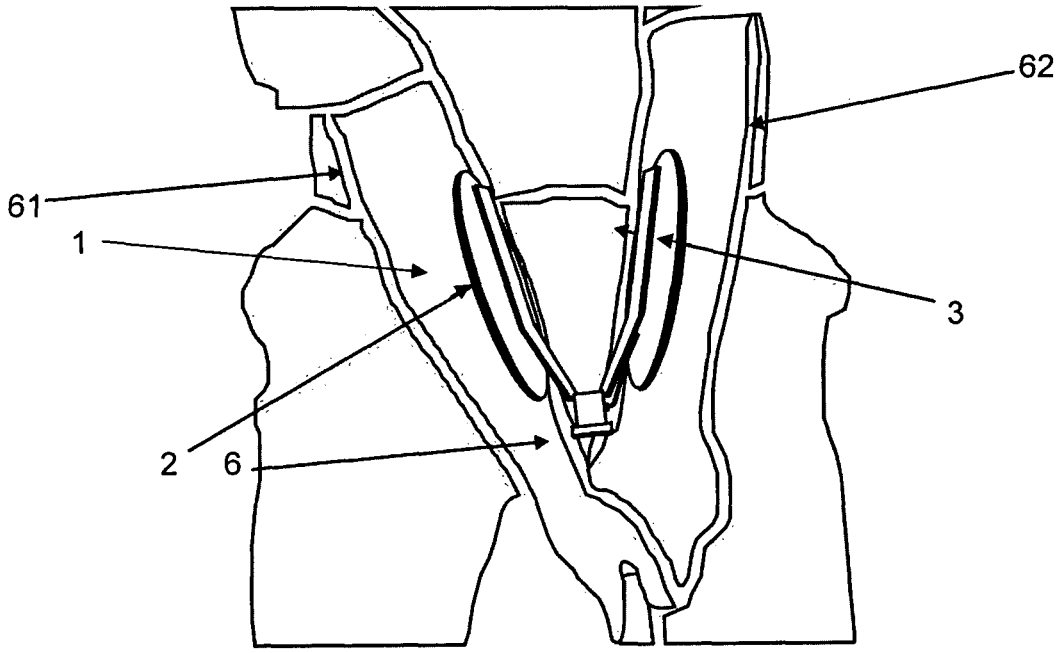
FIG. 6 is a close-up view of the golf aid in use with the user's arms in the address position.
Figure 7:
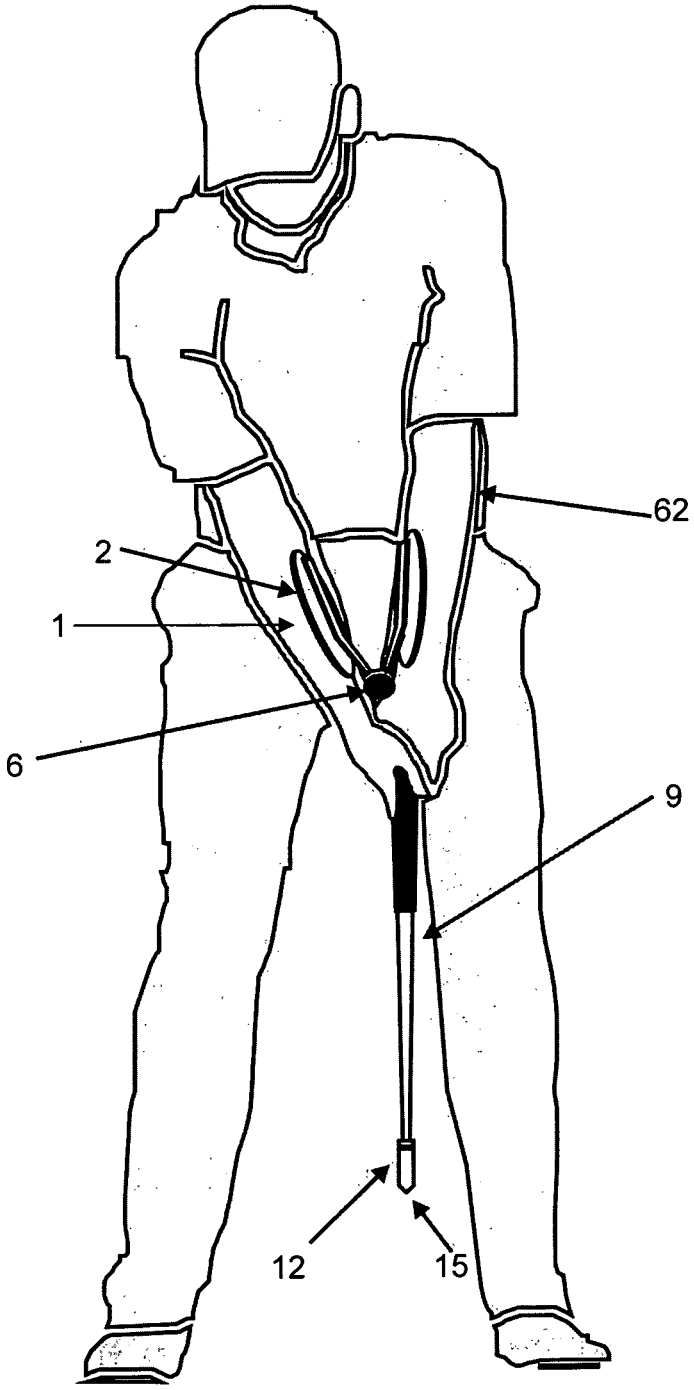
FIG. 7 is a front view of a user with arms in the address position using the golf aid of a preferred embodiment of the present invention.
Figure 8:
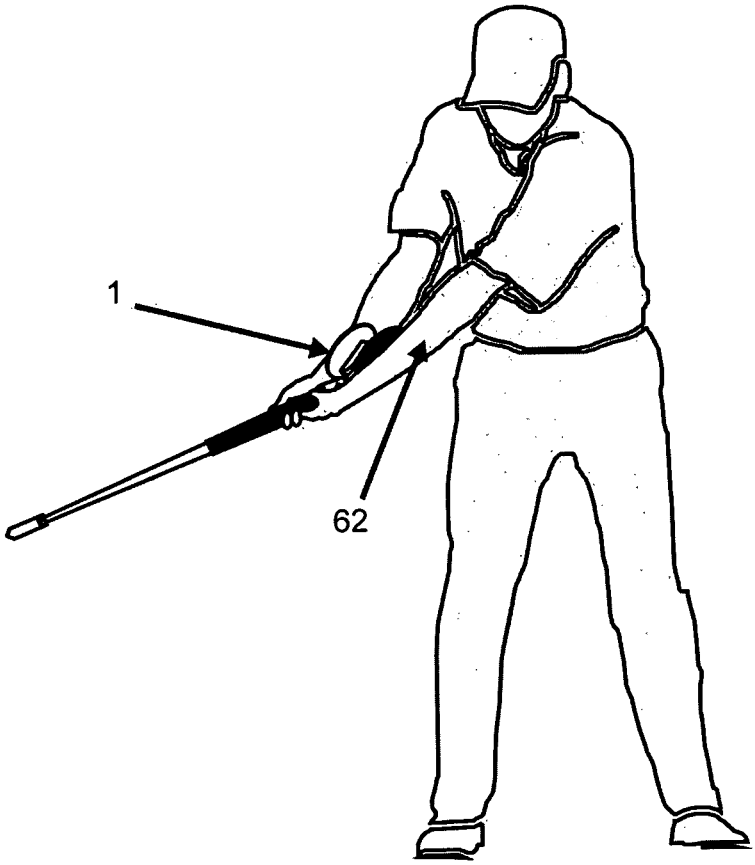
FIG. 8 is a front view of a user showing the use of the golf aid of a preferred embodiment in the user's backswing.

In use, a user locates the forearm guide portions 2 against the inside portion of their right 61 and left 62 forearms whilst taking the correct grip on a club, whether practice or real. This locates the golf aid 1 between the forearms with magnetic housing 6 approximately between the user's wrists as illustrated in FIG. 6. The user may then initiate the swing as illustrated in FIG. 7. Normally, prior to initiation of the swing known as the takeaway, the user will typically squeeze their forearms together against the biasing force of the resilient V-shaped tension yoke 3. The user may then use the golf aid 1 to maintain pressure on the forearm guide portions 2 during the backswing and downswing.

Figure 9:
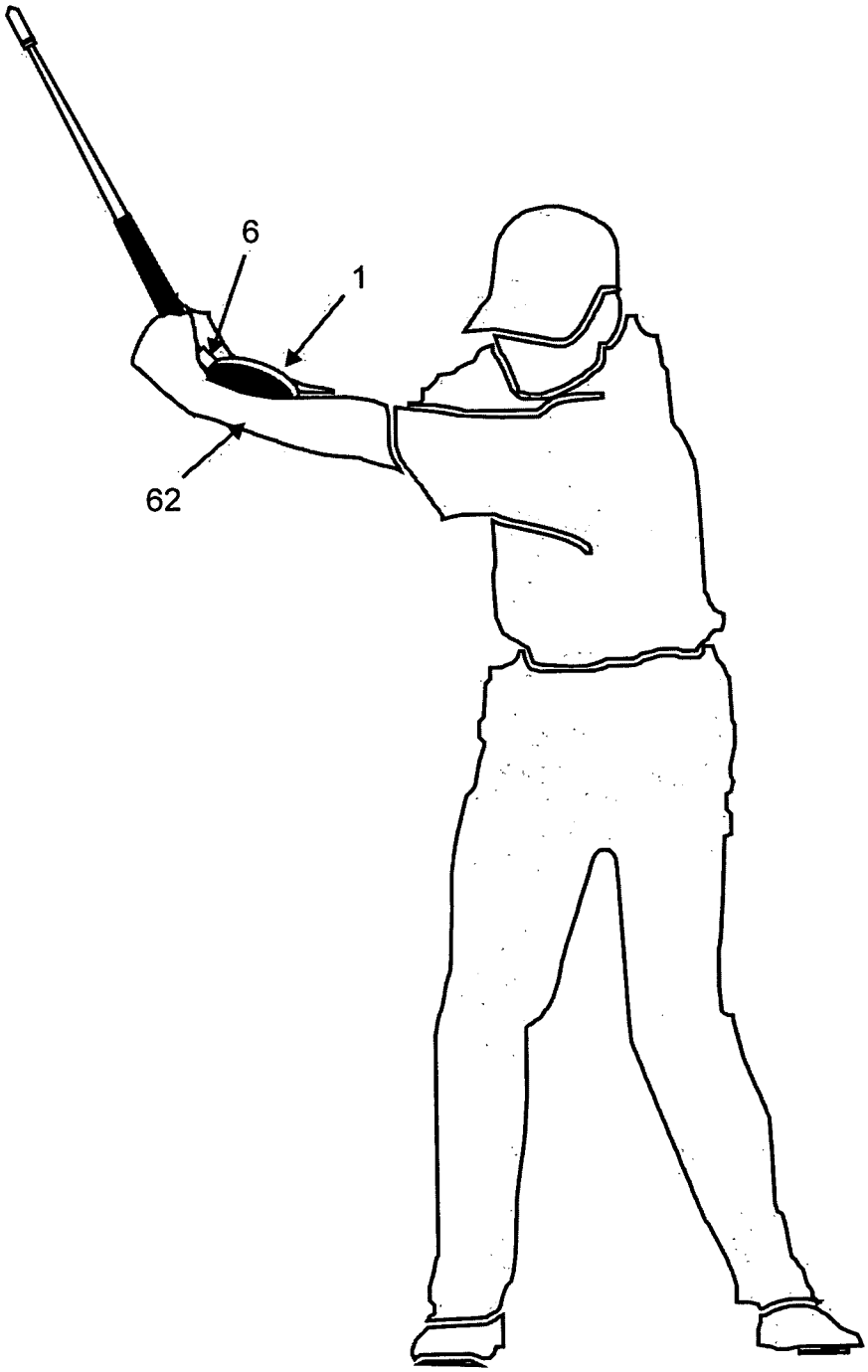
FIG. 9 is a front view of a user showing the use of the golf aid of a preferred embodiment at a point approximately ¾ through the backswing.

The golf aid of the present invention is particularly adapted to allow the correct wrist hinge during the golf swing, as illustrated in FIG. 9 in particular, as no component of the golf aid engages or impinges against either wrist of the user during the swing.

Figure 10:
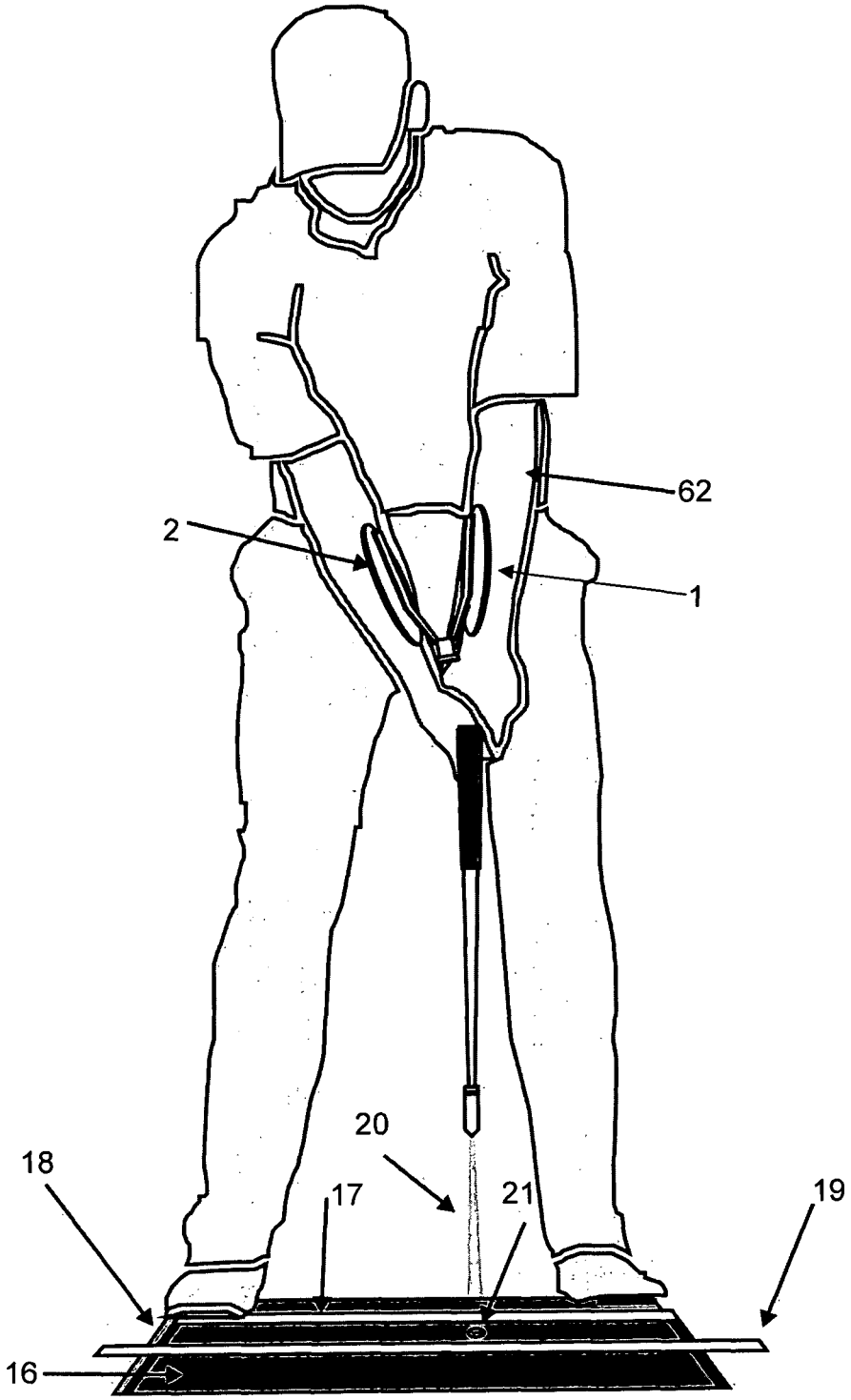
FIG. 10 is a front view of a user with arms in the address position using the golf aid of a preferred embodiment of the present invention with the light source of the golf aid visually displaying the path of the swing between the visual guides on the practice turf.
Figure 11:
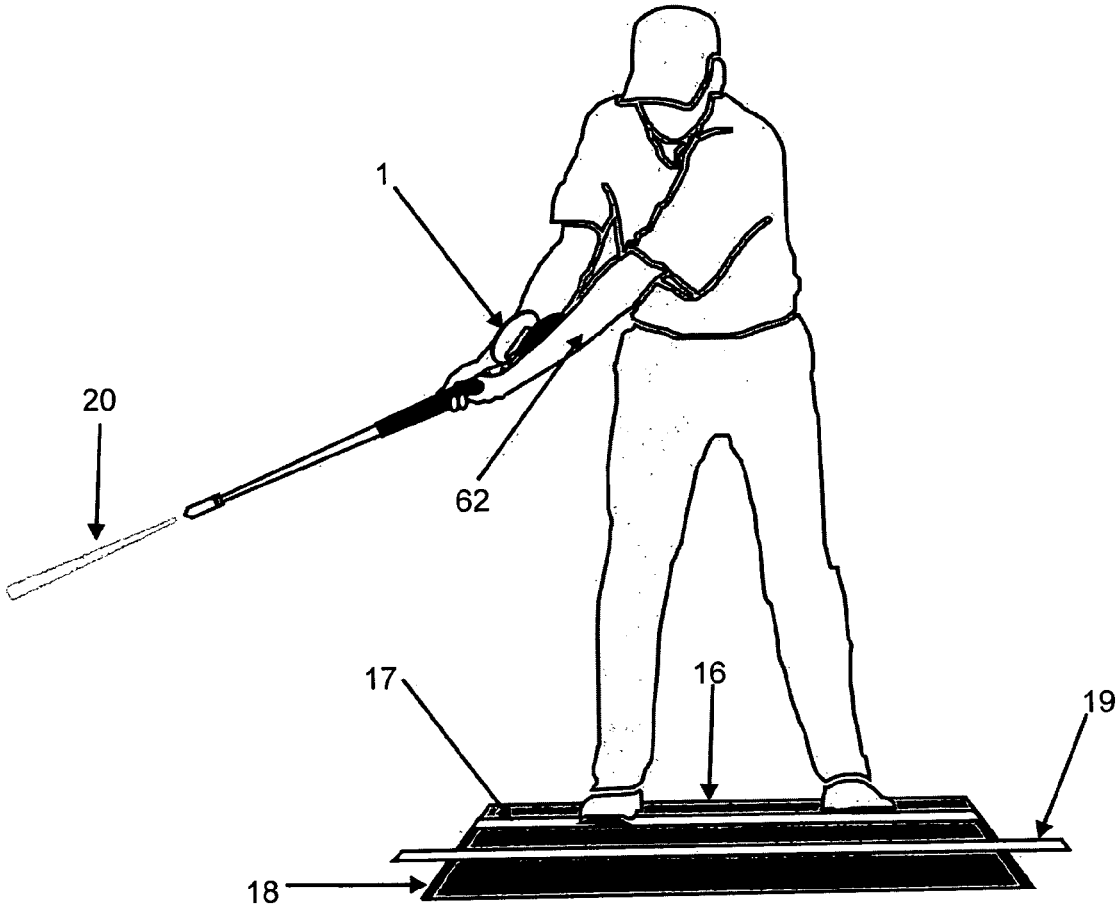
FIG. 11 is a front view of a user showing the use of the golf aid of a preferred embodiment in the user's backswing with the light source of the golf aid visually displaying the path of the swing.
Figure 12:
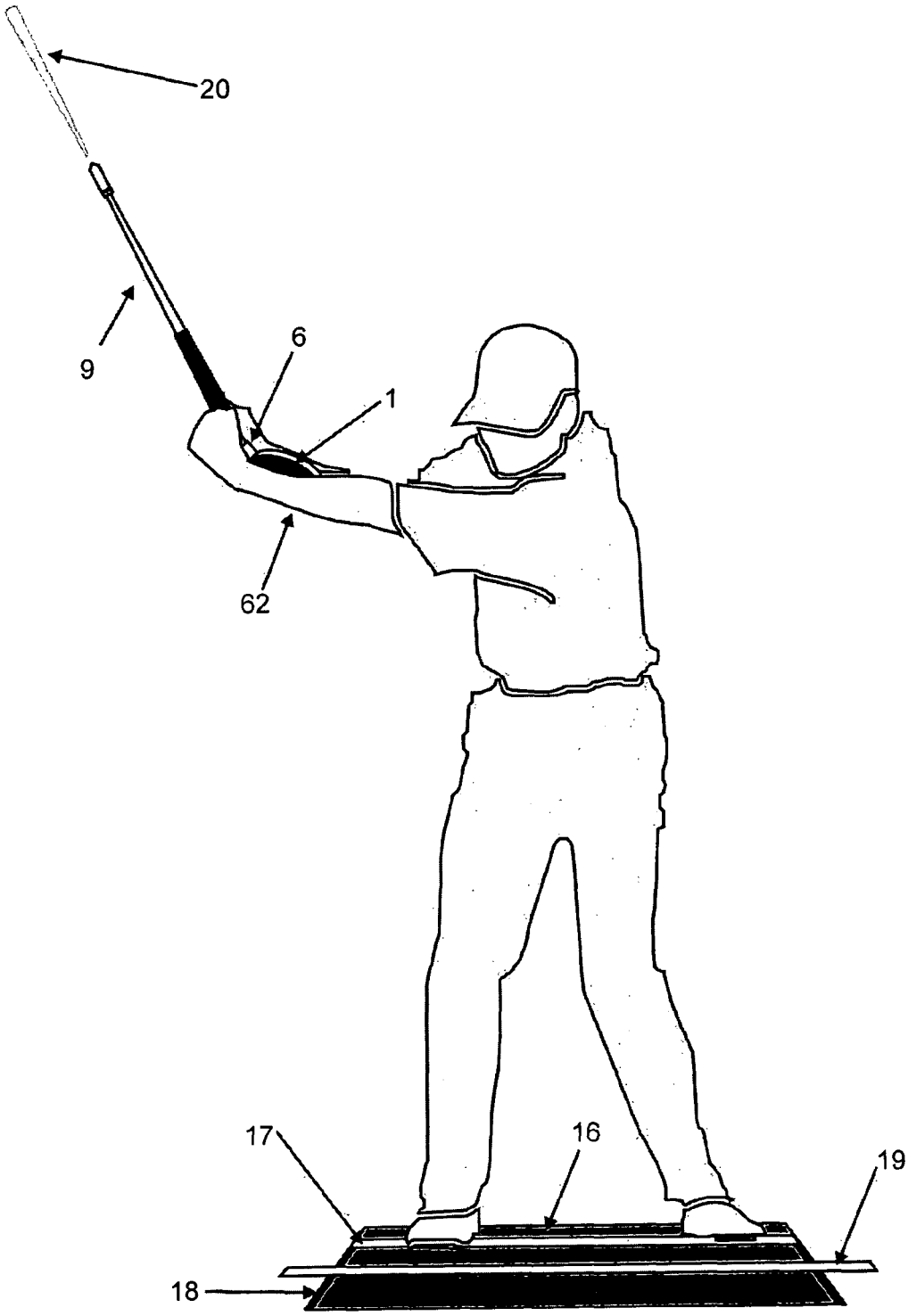
FIG. 12 is a front view of a user showing the use of the golf aid of a preferred embodiment at a point approximately ¾ through the backswing with the light source of the golf aid visually displaying the path of the swing.
Figure 13:
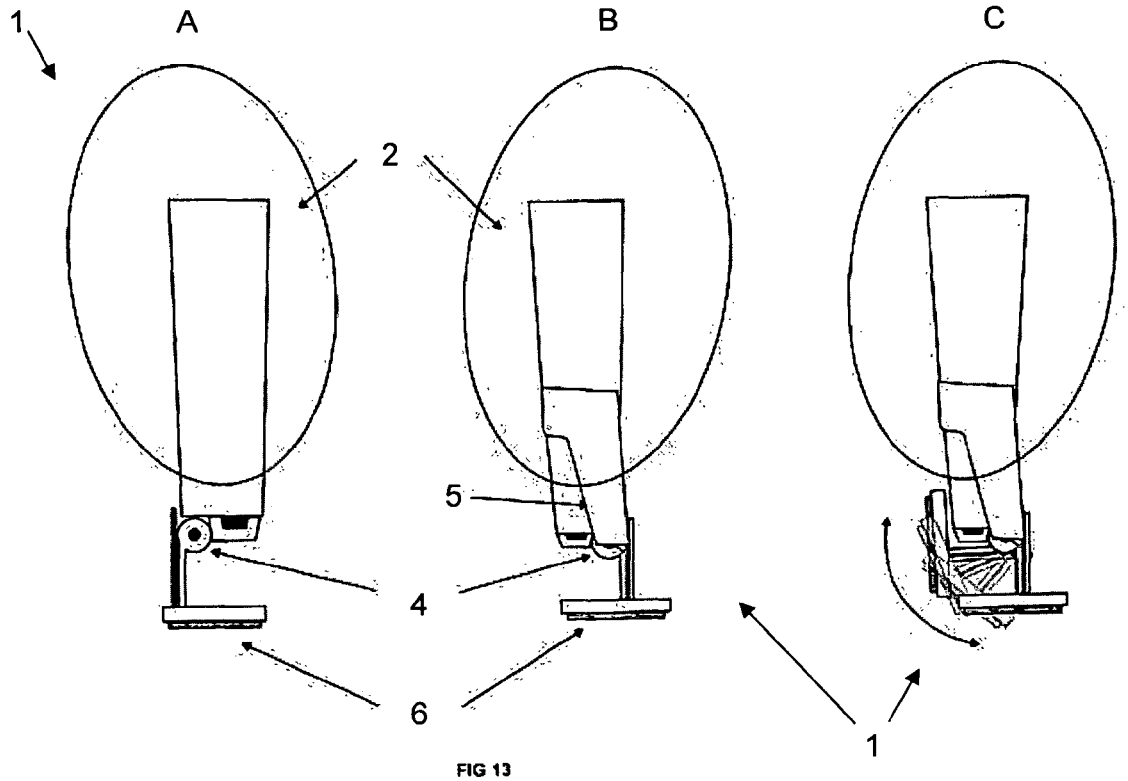
FIG. 13 shows the side views of the golf aid of a preferred embodiment with the magnetic housing held by the tension clip and with the magnetic housing released by the tension clip and free to rotate.
Figure 14:
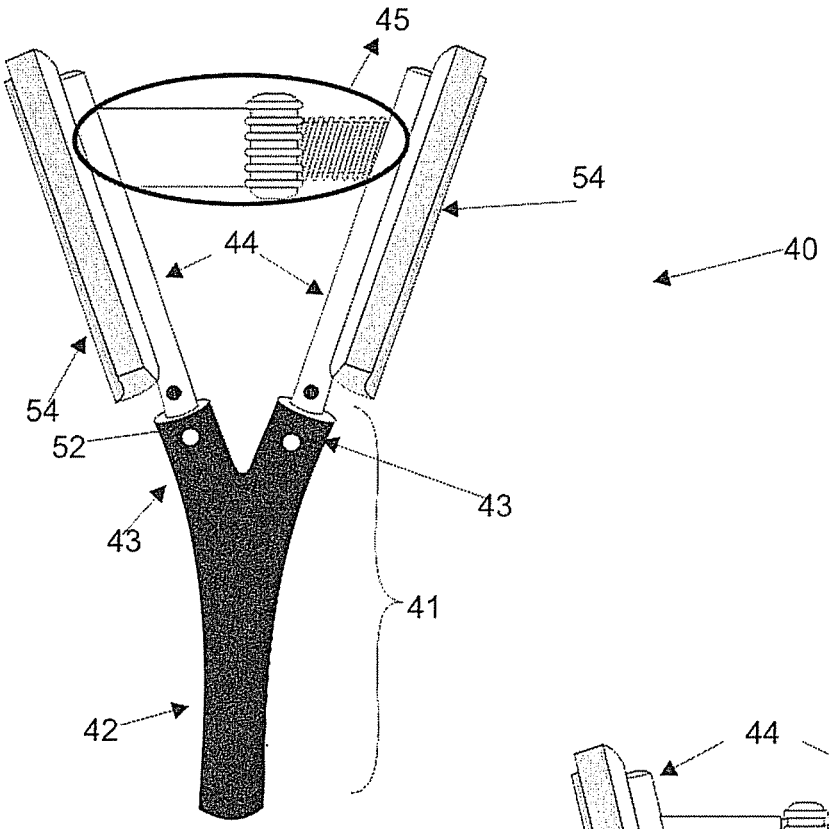
FIG. 14 is a front view of a golf aid according to an alternative embodiment of the present invention in the extended condition.
Figure 15:
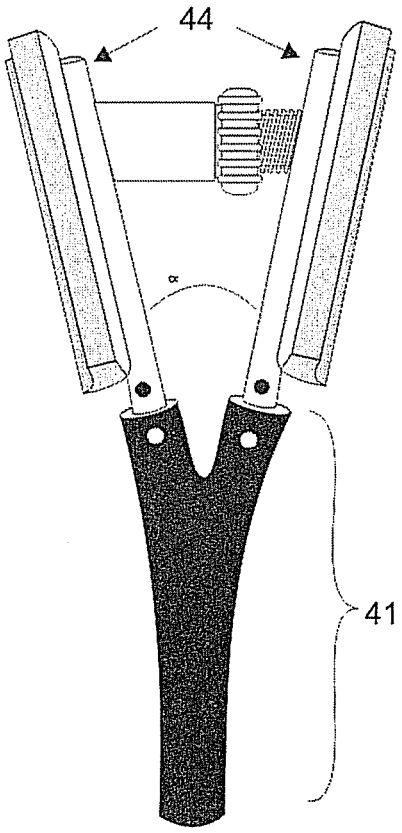
FIG. 15 is a front view of a golf aid as illustrated in FIG. 14 but in the compressed condition.

FIGS. 10 to 12 illustrate the use of the golf aid 1 of the present invention in use with the practice mat 16 to assist with the tracking of the visual path of the swing, with the projection of light 20 onto the practice mat 16 to create a visual indicator 21 which visually displays the path of the swing in relation to the fixed visual guide 17 and the adjustable visual guide 19.

FIGS. 13A, 13B and 13C show side views of the golf aid 1 of the present invention. FIGS. 13A and 13B show the tension clip 5 engaged with the holding means 5*b* (not shown) on the magnetic clip 6, this prevents rotation of the magnetic clip 6 via the hinge 4. FIG. 13C shows the tension clip 5 disengaged with the holding means 5*b* (not shown) this enables rotation of the magnetic clip 6 relative via the hinge 4.

In a second preferred embodiment as per FIGS. 14 to 23, a golf aid 40 is provided.

As illustrated in the Figures particularly FIGS. 14 to 17, the golf aid 40 includes a flexible Y-shaped yoke 41 with a depending portion 42 and a pair of the divergent upper portions 43, a pair of forearm guide portions 44, one associated with each of the divergent upper portions 43 of the yoke 41 and a resilient spacing assembly 45 positioned between the forearm guide portions 44 and biased into an extended condition whereby a user's forearms apply force to the forearm guide portions 44 against the biasing force of the spacing assembly 45 in order to maintain optimum spacing between the user's forearms during the swing.

The golf aid of the present invention can also be used to assist with the initiation of the swing or a swing trigger.

Typically, the golf aid 40 of the embodiments illustrated will be used during practice sessions rather than during game play and use of the golf aid in this manner is illustrated in FIGS. 20 to 23.

Figure 16:
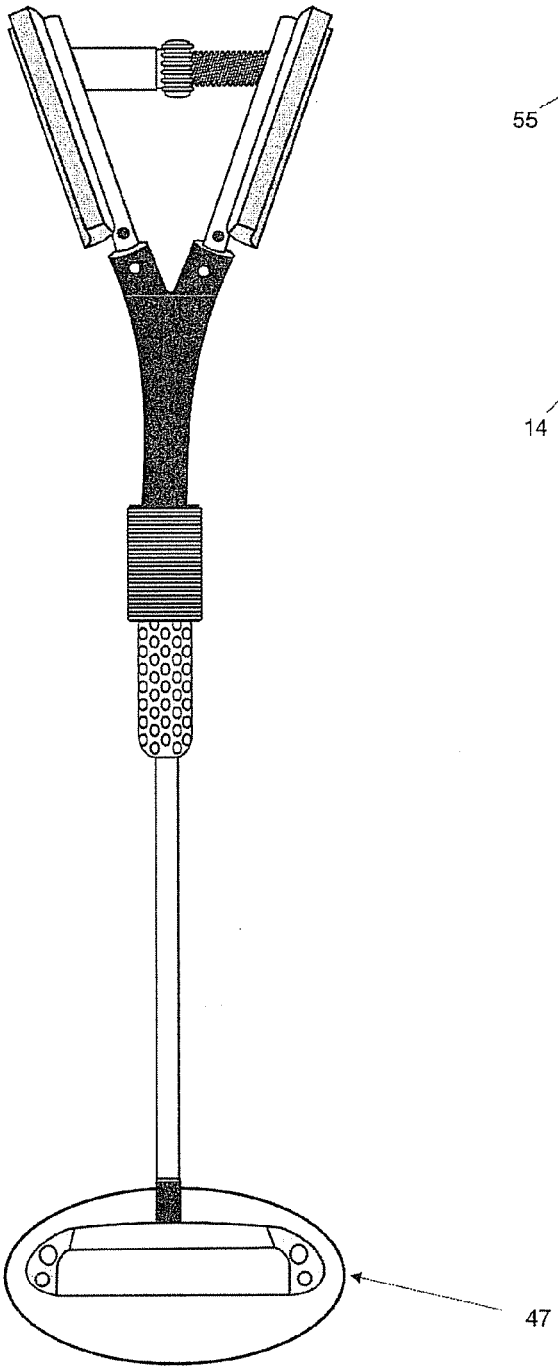
FIG. 16 is a front view of a golf aid with practice club according to an alternative embodiment of the present invention.
Figure 17:
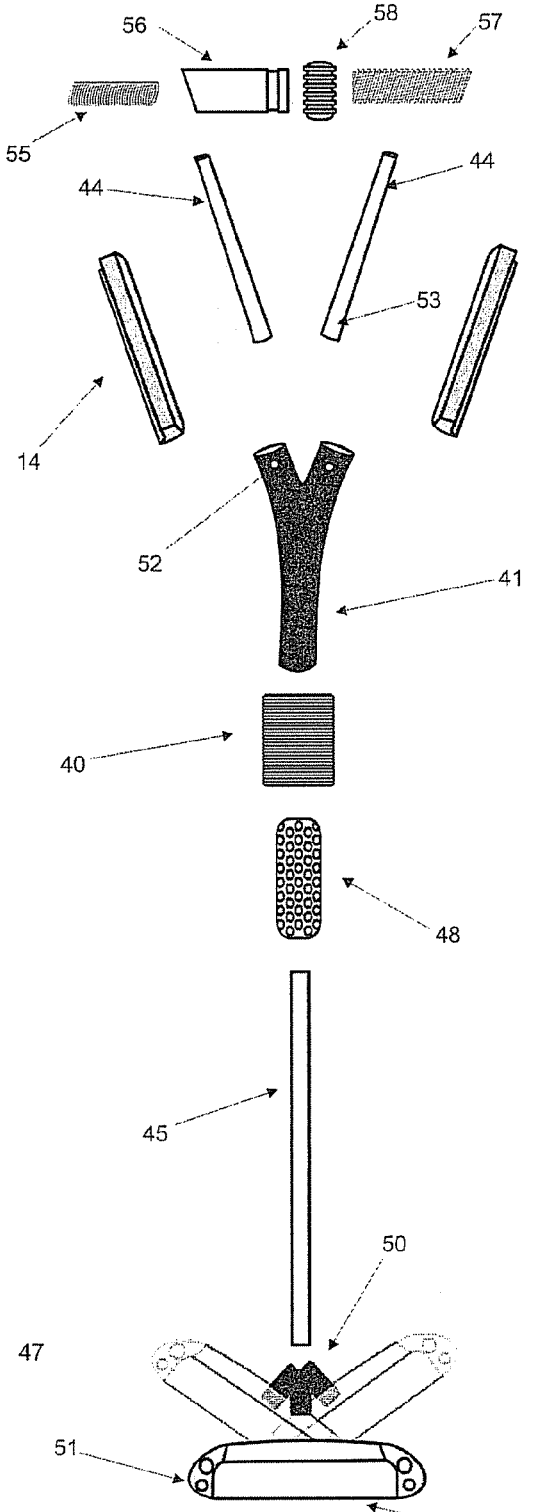
FIG. 17 is an exploded front view of a golf aid and practice club as illustrated in FIG. 16.
Figure 18:
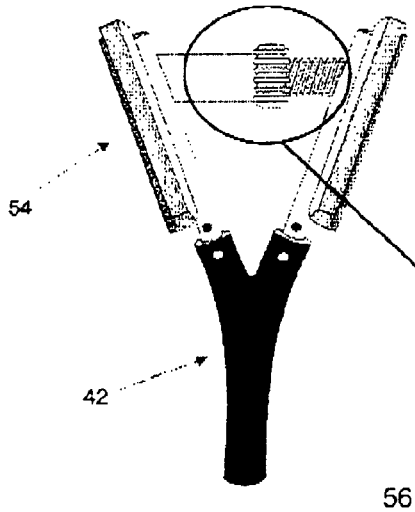
FIG. 18 is a front view of a golf aid as illustrated in FIGS. 14 and 15 with the adjustment assembly highlighted.

The golf aid 40 of the present invention may be utilized with a user's own club (illustrated in FIGS. 21 to 23) or with a practice club specifically designed for use in association with the golf aid, as illustrated in FIGS. 16 and 17. In either case, the club includes an elongate shaft 46 and a head portion 47.

The practice club, as illustrated in FIGS. 16 and 17, includes a shaft 46 manufactured from any existing shaft material such as steel, graphite or composite 20 or a new material.

The practice club shaft of the illustrated embodiment is between approximately one half and three quarters of the length of a normal shaft in order to allow the practice club and golf aid to be used indoors.

As illustrated, the shaft 46 is attached to the yoke 41 of the golf aid 40 via a connector assembly. The connector assembly has a dual purpose of connecting the shaft 46 to the golf aid 40 and also providing a gripping portion.

The illustrated connector assembly includes two components, namely a collar portion that receives a portion of the shaft and also a sleeve portion which received the collar portion and the depending portion of the yoke of the golf aid.

According to the embodiment illustrated in FIG. 17, a pivot 50 is provided towards the lower end of the shaft 46 of the practice club. The head 47 of the practice club is attached to the remainder of the shaft 46 with a short portion of shaft extending from the head 47 and attached to the remainder of the shaft 46 at the pivot 50.

The head of the practice club illustrated has features to increase the air resistance as the club is swung. This can be accomplished using vents or openings 51 for example as illustrated. Further still, providing a weighted head will increase the centripetal force acting on the club as the club is swung.

The yoke 41 is resilient and the preferred form is manufactured from rubber or a similar resilient material. The yoke 41 is also hollow in order to receive other elements of the golf aid or club therein.

The yoke of the preferred embodiment illustrated includes openings 52 in each of the upper portions 43 adjacent the upper terminus in order to receive protrusions 53 provided on the forearm guide portions 44 to attach the components to one another. Normally, a series of protrusions 43 are provided in order to allow length adjustment.

Normally, the forearm guide portions 44 are located in openings in the divergent upper portions 43 of the yoke 41. Similarly, the depending portion 42 of the yoke 41 may be adapted to receive a shaft 46 of either a practice club or a normal golf club or the above described connector assembly may be used to attach a shaft to the yoke.

Figure 20:
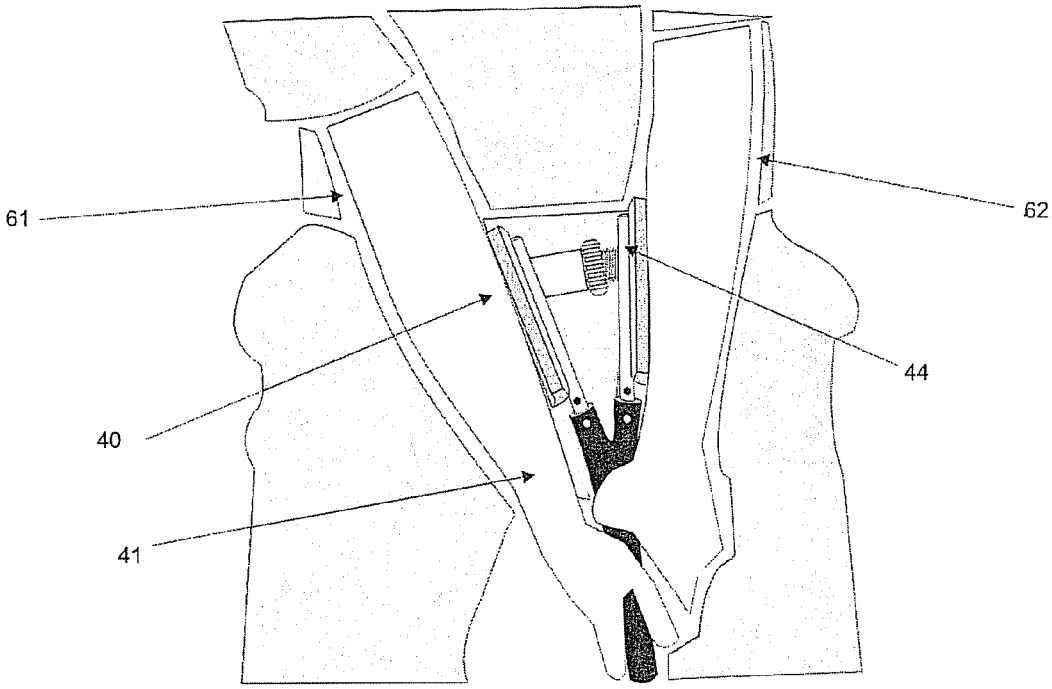
FIG. 20 is a close-up view of the golf aid in use with the user's arms in the address position.

In use, the yoke 41 will normally be located between the wrists of the user in the correct address position as illustrated in FIG. 20.

Each of the forearm guide portions 44 may be alternatively termed a "support post".

Each of the support posts 44 will normally be manufactured from plastic or metal. In order to be relatively lightweight, a tubular construction is preferred.

The forearm guide portions 44 of the illustrated embodiment are between 10 cm and 30 cm in length. The guide portions are dimensioned to fit with in the openings in the upper portions 43 of the yoke 41.

The forearm guide portions 44 each have an associated cushioning member 54 covering the length of the forearm guide portions 44. The illustrated cushioning members 54 are arcuate in cross-section over its length to comfortably abut a user's forearm. The cushioning members 54 are longer than the forearm guide portions 44 in order to cover the end of the forearm guide portions 44.

The golf aid 40 of the present invention also includes a resilient spacing assembly 45 positioned between the forearm guide portions 44 and biased into an extended condition whereby a user's forearms apply force to the forearm guide portions 44 against the biasing force in order to maintain optimum spacing between the user's forearms during the swing.

Typically, the minimum angle, a, between the forearm guide portions 44 is set by the resilient spacing assembly 45. A maximum angle may also be set. According to the preferred embodiment, the forearm guide portions 44 are biased into a maximum separation through use of a biasing spring 55 in the separation assembly.

In the illustrated embodiment, the resilient spacing assembly 45 includes four components namely a body 56, a plunger 57 which is telescopically received at least partially within the body 56, a biasing spring 55 to bias the body 56 and a plunger 57 into an extended condition and an adjustment knob 58 to adjust the minimum separation angle of the forearm guide portions 44.

The resilient spacing assembly 45 extends between the forearm guide portions 44. The body 56 of the spacing assembly 45 is attached or secured to one of the forearm guide portions 44 and the plunger 57 is attached or secured to the other of the forearm guide portions 44.

Figure 19:
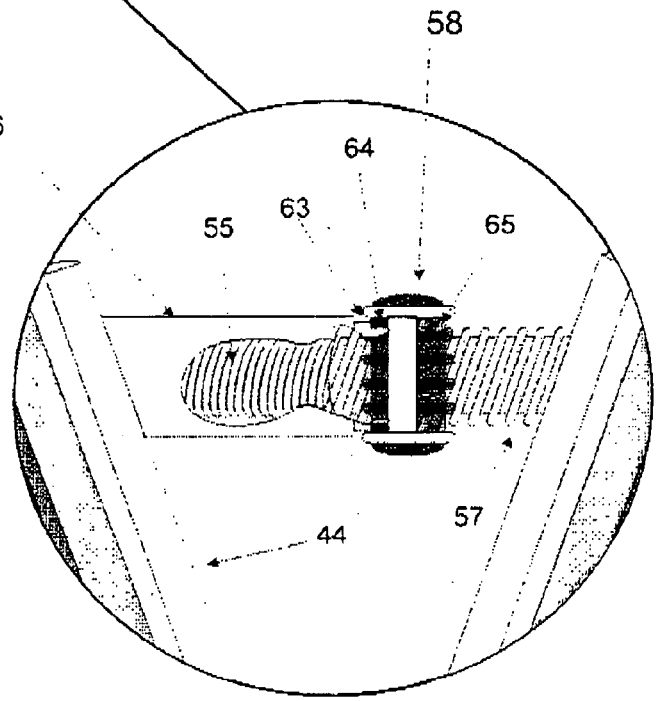
FIG. 19 is a detailed view of the adjustment assembly as illustrated in FIG. 18.

As illustrated best in FIG. 19, the biasing spring 55 is at least partially received within a hollow portion of the body 56 and adjacent the end of the plunger 57 in order to be braced against the body 56 and act on the plunger 57 to bias the two components apart.

The spring 55 is located in a housing 59 located inside the body 56 and rotation of the externally provided knob 58 along an externally threaded portion 60 of the body 56 moves the housing 59 toward/away from the plunger 57, thus changing the effective length of the body 56 and plunger 57 and thereby changing the angle between the forearm guide portions 44.

Figure 21:
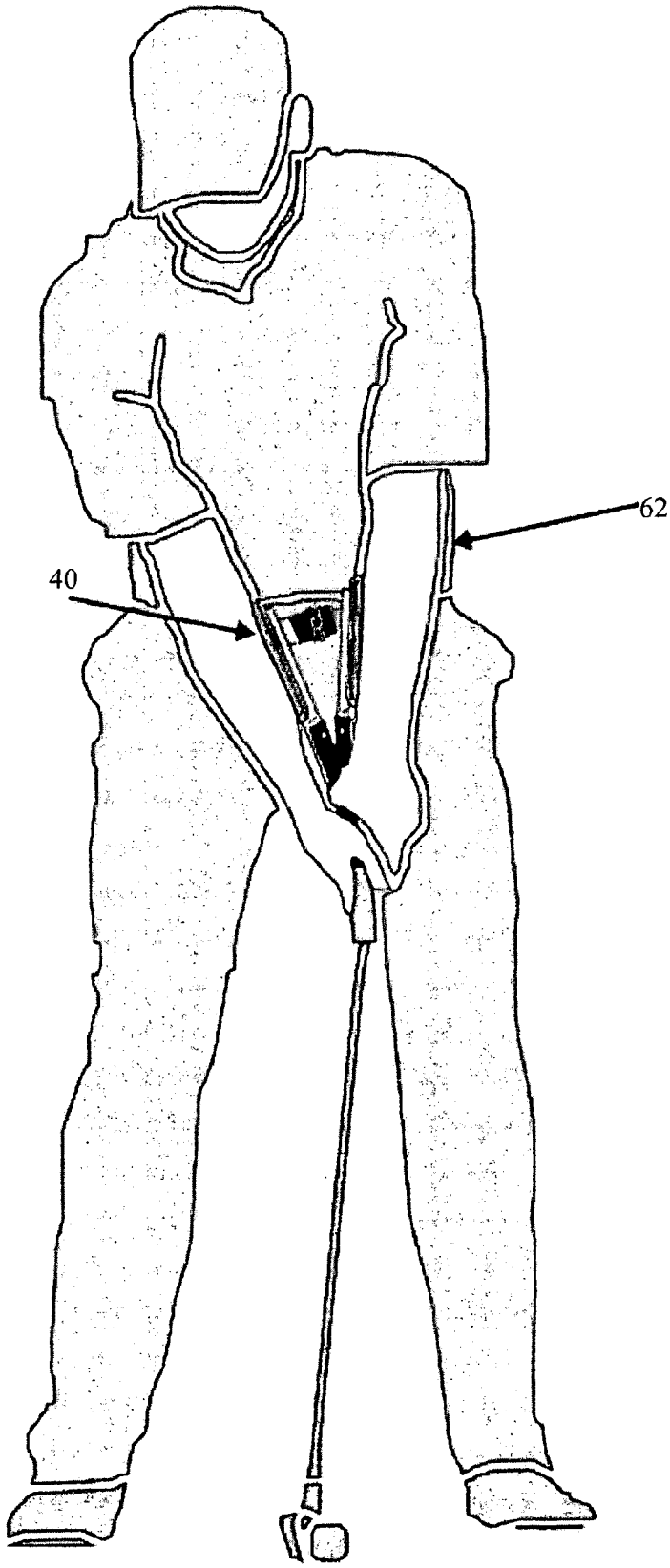
FIG. 21 is a front view of a user with arms in the address position using the golf aid of an alternative embodiment of the present invention.
Figure 22:
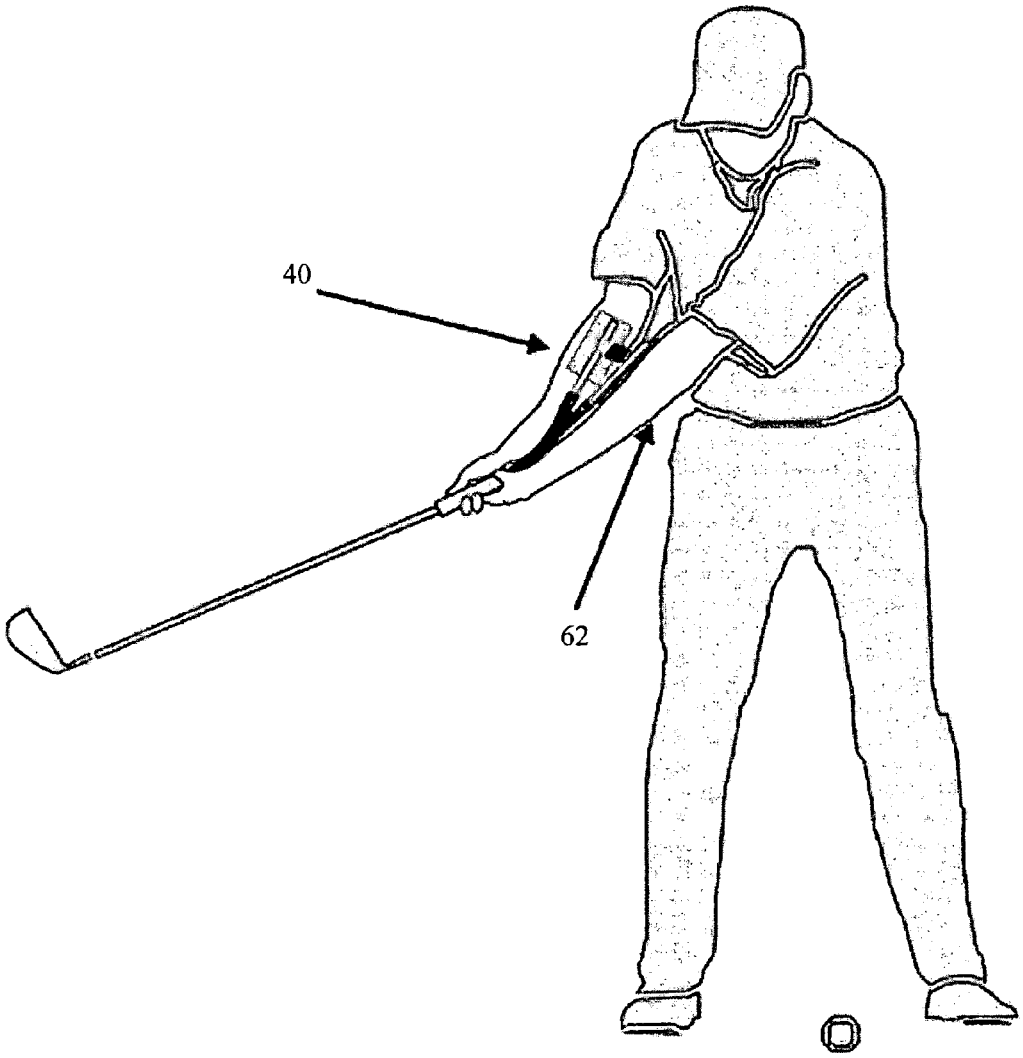
FIG. 22 is a front view of a user showing the use of the golf aid of an alternative embodiment in the user's backswing.

In use, a user locates the arm guides 44 against the inside portion of their right 61 and left 62 forearms whilst taking the correct grip on a club, whether practice or real. This locates the golf aid 40 between the forearms with the yoke 41 approximately between the user's wrists as illustrated in FIG. 20. The user may then address a golf ball as illustrated in FIG. 21. Normally, prior to initiation of the swing known as the takeaway, the user will typically squeeze their forearms together against the biasing force of the resilient spacing assembly. The user may then use the golf aid 40 to maintain pressure on the forearm guide portions during the backswing and downswing.

Figure 23:
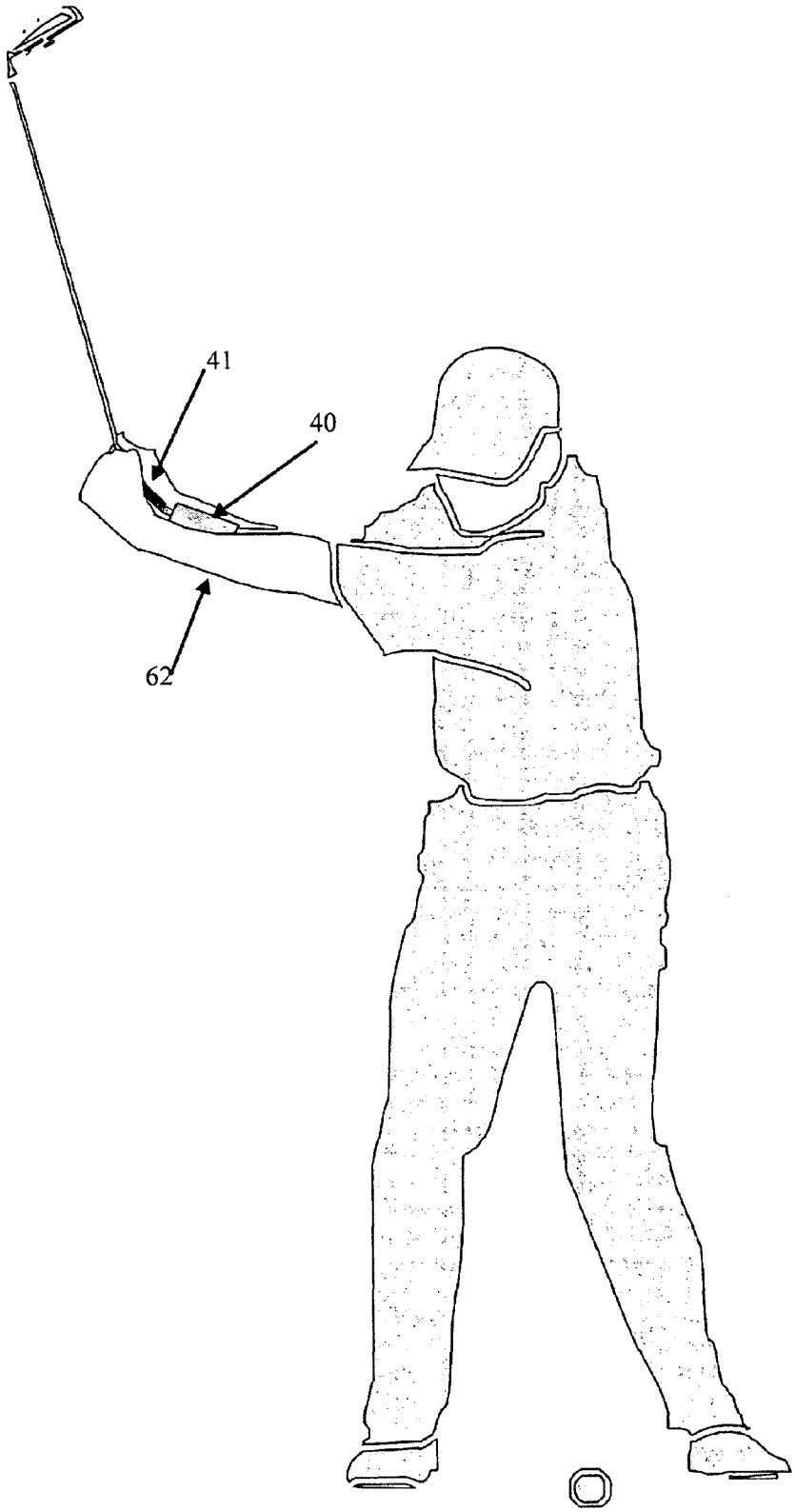
FIG. 23 is a front view of a user showing the use of the golf aid of an alternative embodiment at a point approximately ¾ through the backswing.

The golf aid of the present invention is particularly adapted to allow the correct wrist hinge during the golf swing, as illustrated in FIG. 23 in particular, as no component of the golf aid engages or impinges against either wrist of the user during the swing.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A golf aid comprising:

a resilient V-shaped yoke with a pair of divergent upper portions and a resilient spacing means located between the pair of divergent upper portions, a pair of forearm guide portions, one associated with each of the divergent upper portions of the yoke, with a resilient means to bias the forearm guide portions into an extended condition, whereby a user's forearms apply force to the forearm guide portions against a biasing force in order to maintain optimum spacing between the user's forearms, a practice club associated with the yoke, the practice club comprising a shaft and a head, wherein the club is at least partially restricted from freely pivoting relative to the yoke, and a connector assembly comprising a hinge associated with a magnetic device to provide a removable connection between the yoke and the practice club, the hinge being releasably held in place by a tension clip, the tension clip being associated with the one of the forearm guide portions such that compression of the yoke moves the tension clip releasing the hinge and allowing the magnetic device to rotate about the hinge.

2. A golf aid as claimed in claim 1 wherein the length of said shaft of said practice club is between approximately one half and approximately three quarters of the length of a standard-sized golf club.

3. A golf aid as claimed in claim 1 wherein said head includes a visual indicator means.

4. A golf aid as claimed in claim 1 wherein said practice club shaft includes a pivot point provided at or towards the lower end of the shaft of the practice club.

5. A golf aid as claimed in claim 4 wherein a first short portion of said shaft of said practice club is provided extending from the head and is attached to a second portion of the shaft at the pivot.

6. A golf aid as claimed in claim 1 wherein said head of said practice club has an enlarged shape to increase the air resistance as the club is swung.

7. A golf aid as claimed in claim 1, further comprising a pair of elongate forearm guide portions, one associated with each of the pair of divergent upper portions of the yoke.

8. A golf aid as claimed in claim 1 wherein the biasing force of the yoke is adjustable.

9. A golf aid as claimed in claim 8 wherein the biasing force of the yoke can be adjusted by substituting the yoke with different material and/or different thicknesses.

10. A golf aid as claimed in claim 1 wherein said yoke is a resilient V-shaped tension yoke, and the resilient spacing means is the biasing force of the yoke.

11. A golf aid as claimed in claim 1 wherein said yoke is a flexible Y-shaped yoke further comprising a depending portion, and the resilient spacing means of the yoke is a resilient spacing assembly.

12. A golf aid as claimed in claim 11 wherein the yoke is resilient and hollow in order to receive other elements thereinto.

13. A golf aid as claimed in claim 12 wherein the forearm guide portions are located in openings in the divergent upper portions of the yoke.

14. A golf aid as claimed in claim 13 wherein the guide portions are dimensioned to fit within the openings in the respective divergent upper portions of the yoke in an interference fit.

15. A golf aid as claimed in claim 11 wherein the depending portion of the yoke is adapted to receive a portion of either a practice club or a golf club.

16. A golf aid as claimed in claim 11 wherein said resilient spacing assembly is provided between the divergent upper portions of the yoke and biases the forearm guide portions into maximum separation but is compressible against the biasing force.

17. A golf aid as claimed in claim 11 wherein said resilient spacing assembly includes a body, a plunger which is telescopically received at least partially within the body, a biasing means to bias the body and plunger into an extended condition, and a threaded adjustment mechanism between the plunger and the body to adjust the effective length of the resilient spacing assembly.

18. A golf aid as claimed in claim 17 wherein said body of the spacing assembly is attached or secured to one of the forearm guide portions and the plunger is attached or secured to the other of the forearm guide portions.

19. A golf aid as claimed in claim 17 wherein said biasing means is a spring at least partially received within a hollow portion of the body and adjacent the end of the plunger in order to be braced against the body or portion thereof and act on the plunger to bias the two components apart.

20. A golf aid as claimed in claim 19 wherein said spring is located in a hollow housing portion located inside the body and rotation of an externally provided knob operatively associated with the housing moves the housing toward/away from the plunger, thus changing the effective length of the body and plunger.

21. A golf aid as claimed in claim 1 wherein said head of the practice club is adapted to hit golf balls.

22. A golf aid system comprising:

the golf aid of claim 1; and a practice mat used with the golf aid to visually trace the path of the users swing.

23. A golf aid system as claimed in claim 22 wherein said practice mat has one or more visual guides such that the path of the swing can be compared with the visual guides.

24. A golf aid system as claimed in claim 23 wherein the position of at least one of said visual guides is adjustable on the practice mat.

* * * * *